United States Patent [19]

Knepper

[11] 4,447,090

[45] May 8, 1984

BEST AVAILABLE COPY

[54] PROCESS FOR FORMING AN IN SITU OIL SHALE RETORT

[75] Inventor: Jay C. Knepper, Denver, Colo.

[73] Assignees: Standard Oil Company, a corporation of Indiana; Gulf Oil Corporation a corporation of Pennsylvania, both of Chicago, Ill.

[21] Appl. No.: 392,684

[22] Filed: Jun. 28, 1982

[51] Int. Cl.[3] ..... E21C 41/10

[52] U.S. Cl. ..... 299/2; 102/312

[58] Field of Search ..... 299/2, 13; 102/311, 102/312

[56] References Cited

U.S. PATENT DOCUMENTS 4,266,826 5/1981 French ..... 299/13 X

*Primary Examiner*—Ernest R. Purser

*Attorney, Agent, or Firm*—Thomas W. Tolpin; William T. McClain; William H. Magidson

[57] ABSTRACT

A process is provided for forming an in situ oil shale retort which minimizes channeling, explosion gas turbulence and flame front tilting. In the process, explosives are detonated in an underground formation of oil shale to blast the oil shale into a permeable rubblized mass defining a retort, and gases emitted from the explosion are symmetrically vented. In the preferred form, the gases are vented through vertical vent holes and blast holes which extend through the top of the retort, as well as through a lateral access tunnel which extends into the bottom of the retort.

9 Claims, 2 Drawing Figures

PROCESS FOR FORMING AN IN SITU OIL SHALE RETORT

BACKGROUND OF THE INVENTION

This invention relates to underground retorting of oil shale, and more particularly, to a process of forming an in situ oil shale retort.

Researchers have now renewed their efforts to find alternative sources of energy and hydrocarbons in view of recent rapid increases in the price of crude oil and natural gas. Much research has been focused on recovering hydrocarbons from solid hydrocarbon-containing material such as oil shale, coal and tar sand by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah, and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, steam and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts above ground or in situ retorts underground. In situ retorts require less mining and handling than surface retorts.

In in situ retorts, a flame front is continuously passed downward through a bed of oil shale to liberate shale oil, off gases and oil shale retort water. There are two types of in situ retorts: true in situ retorts and modified in situ retorts. In true in situ retorts, all of the oil shale is retorted underground as is, without mining or transporting any of the shale to above ground locations. The shale can be explosively rubblized, if desired. In modified in situ retorts, some of the oil shale is mined and conveyed to the surface to create an underground cavity or void space in the retorting area. The remaining underground oil shale is then explosively rubblized to substantially fill the void space. The oil shale which has been conveyed to the surface is retorted above ground.

Over the years various methods have been suggested for explosively forming and retorting in situ oil shale retorts. Typifying these methods and other methods of underground mining are those found in U.S. Pat. Nos. 3,762,771; 3,980,339; 4,043,595; 4,043,596; 4,043,597; 4,043,598; 4,146,272; 4,175,490; 4,192,553; 4,192,554; 4,201,419; 4,205,610; 4,210,366; 4,245,865; 4,262,965; 4,272,127; and Canadian Pat. No. 1,012,564. These prior art methods have met with varying degrees of success.

In forming in situ retorts, explosion gases are conventionally vented through the bottom or, alternatively through a vertical wall of the retort. The explosion gases are constrained by the roof and other walls of the retort, and are deflected back through crevices in the rubblized mass and along the walls of the retort before being vented. Such deflection causes undesirable backflow, turbulence and crevice expansion, which create enlarged vertical, horizontal and irregular channels throughout the rubblized bed and along the retort walls. As a result, during retorting, hot gases flow down these channels and often bypass large portions of the bed, leaving significant portions of the rubblized shale unretorted.

Channelling also causes many deleterious effects including tilted (nonhorizontal) and irregular flame fronts in close proximity to the retorting zone, as well as fingering, that is, flame front projections which extend downward into the raw oil shale far ahead of other portions of the flame front. Irregular and tilted flame fronts can lead to flame front or oxygen breakthrough, incomplete retorting and burning of the product shale oil. Flame fronts in close proximity to the advancing front of the retorting zone can also cause combustion of product shale oil. If a narrow portion of the flame front advances completely through the retorting zone, it can ignite the effluent oil and off gases and may cause explosions. It has been estimated that losses from burning in in situ retorting are as high as 40% of the product shale oil. Fingering can cause coking and thermal cracking of the liberated shale oil.

It is therefore desirable to provide an improved process, which overcomes most, if not all, of the preceding problems.

SUMMARY OF THE INVENTION

An improved process is provided for forming an in situ oil shale retort which minimizes explosion gas turbulence, channeling, tilted flame fronts, fingering, coking and thermal cracking. Desirably, the process is effective, efficient and produces a high quality product slate during retorting.

In the novel process, explosion gases are symmetrically vented out of the retort after the oil shale has been explosively rubblized. Preferably, vent holes are drilled in to the underground formation of oil shale around the vicinity to which the explosive charges are to be placed in order to minimize the distance the explosion gases need to travel in the retort. The vent holes can be symmetrical in the vertical or lateral direction and can include one or more blast holes and tunnels. Desirably, the explosion gases are equally vented in opposite directions.

In the preferred form, an access tunnel is mined laterally into the bottom of the underground formation of oil shale, and a portion of the oil shale, preferably less than 30% by volume, is removed and conveyed above ground, leaving an underground cavity or a void space. Thereafter, a special pattern of blast holes and vent holes are drilled into the underground formation. The size, spacing and quantity of blast holes and vent holes should be such that the total cross-sectional area of the vent holes and blast holes is generally equal to the cross-sectional area of the access tunnel in order to provide symmetrical venting.

After the blast holes and vent holes have been formed in the above manner, explosive charges are placed and set in the blast holes, and are sequentially detonated to explosively expand the oil shale into a permeable rubblized mass which substantially fills the void. Preferably, explosion gases emitted from the explosion are simultaneously vented through the vent holes, blast holes and access tunnel to substantially minimize channeling in the rubblized mass.

Depending on the size of the formation and the type of shale being rubblized, the void can be formed near the middle, bottom or top of the formation and the blast holes and/or vent holes can be drilled in a checkered or circular array or other symmetrical pattern. The vent holes can also be advantageously spaced along the periphery and corner of the retort's roof. In the preferred embodiment, the vent holes, blast holes and tunnel communicate and extend generally upward to the surface to vent the explosion gases to the atmosphere above ground.

As used throughout this application, the terms "retorted oil shale" and "retorted shale" refer to oil shale which has been retorted to liberate hydrocarbons leaving an inorganic material containing carbon residue.

The terms "spent oil shale" and "spent shale" as used herein mean retorted shale from which all of the carbon residue has been removed by combustion.

A more detailed explanation of the invention is provided in the following description and appended claims taken in conjunction with the accompanying drawings.

DETAILED DESCRIPTION OF THE PREFERRED EMBODIMENT

Figure 2:
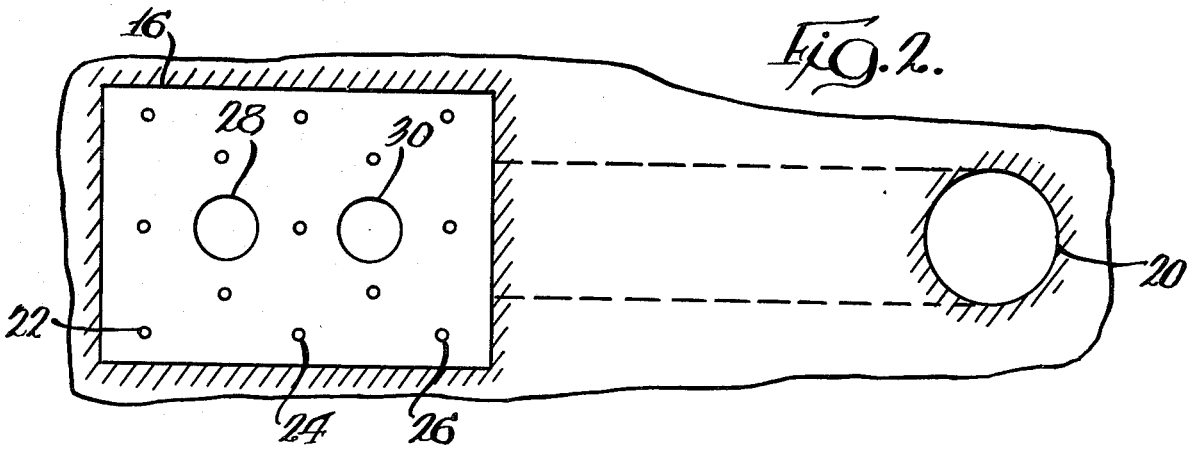
FIG. 2 is a cross-sectional view of the retort taken substantially along line 2—2 of FIG. 1.
Figure 1:
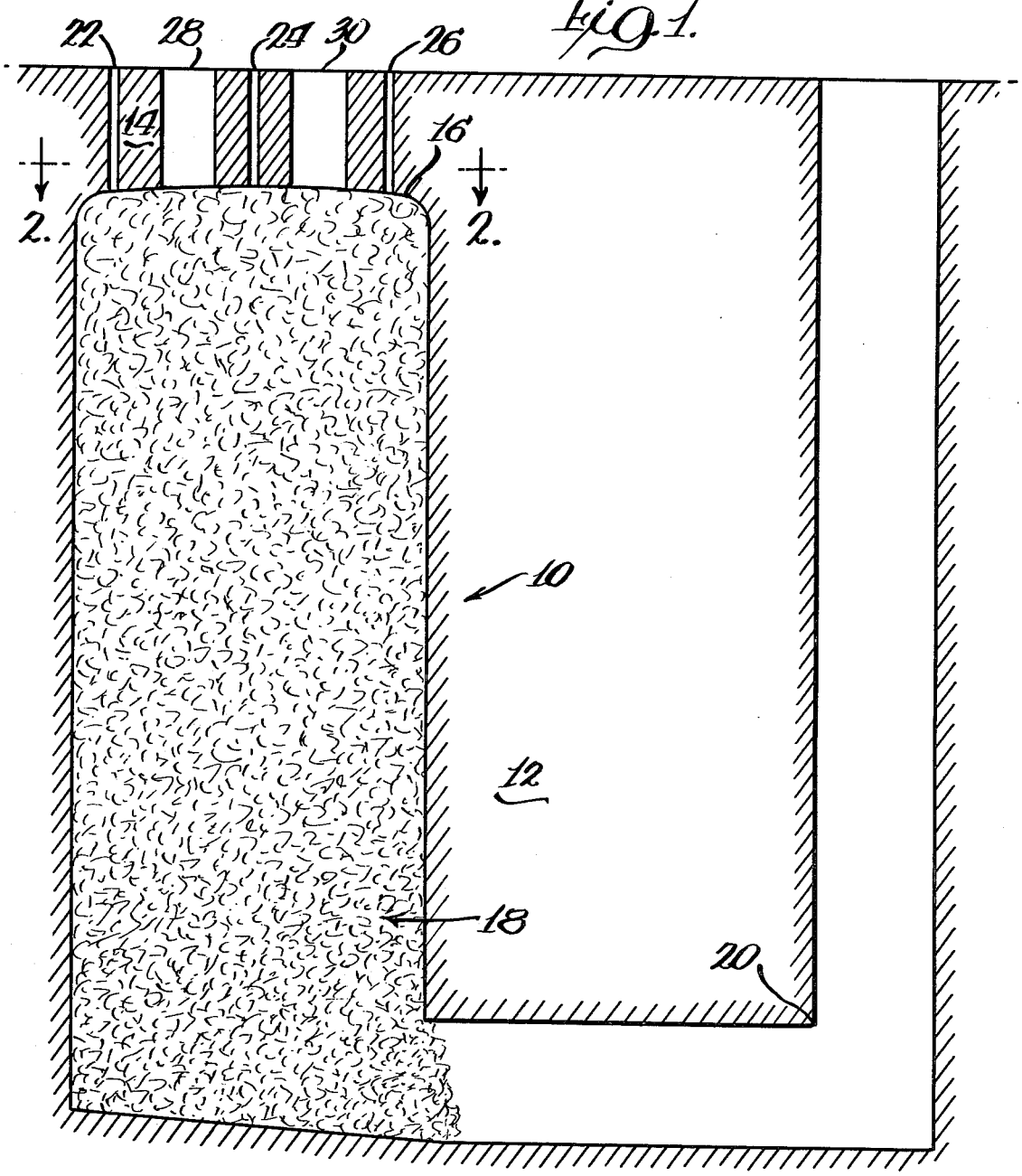
FIG. 1 is a schematic cross-sectional view of an in situ retort which has been explosively formed in accordance with principles of the present invention.

Referring now to FIG. 1 of the drawings, an underground, modified in situ, oil shale retort 10 located in a subterranean formation 12 of oil shale is covered with an overburden 14. Retort 10 is elongated, upright, and generally box-shaped, with a rectangular top and dome-shaped roof 16, and is filled with a relatively uniformly packed, fluid permeable, rubblized mass or bed 18 of oil shale.

The rubblized mass is formed by first mining an access tunnel or drift 20 extending horizontally or laterally into the bottom of retort 10 and removing from 10% to 40% and preferably from 15% to 30% by volume of the oil shale from a central region of the retort to form a cavity or void space. In the preferred embodiment, the access tunnel 20 has a uniform cross-sectional area and extends vertically to the surface. The removed oil shale is conveyed to the surface and retorted in an aboveground retort.

A checkered symmetrical array of upright blast holes, such as blast holes 22, 24 and 26, and a pair of larger diameter vent holes 28 and 30 are vertically drilled through overburden 14, from above ground level to a location within the rubblized mass in proximity to the void. In the illustrative embodiment, all the blast holes are of a similar size and have uniform circular cross-sectional areas, and the circular vent holes are the same size. Desirably, the total horizontal cross-sectional areas of the vent holes and blast holes as viewed from the top of the retort is generally equal to the vertical cross-sectional area of the access tunnel 20 adjacent the bottom of the retort 10 as viewed from the side of the retort.

After the blast holes and vent holes are drilled, the explosive charges are lowered and set in the blast holes and the blast holes are stemmed and optionally plugged. The charges are then detonated to explosively expand and fragment the oil shale into a permeable rubblized mass of oil shale fragments which substantially fill the void. Preferably, the oil shale fragments are explosively rubblized to an average particle size of 1 to 3 inches. Other particles sizes can be used.

Explosion gases emitted from the explosion are vented through the vent holes 28 and 30, blast holes 22, 24, 26, etc., and access tunnel 20 to the atmosphere above ground to substantially minimize explosion gas turbulence and channeling in the rubblized mass. Equal amounts of explosion gases are vented upwardly through the vent holes and blast holes, and downwardly and, thereafter, laterally outwardly and upwardly through the access tunnel.

After the oil shale has been explosively expanded and rubblized in the above manner, a downhole burner is lowered into one of the holes, such as blast hole 22, to a location in proximity to the roof. A fuel gas line and a feed gas line are installed in other holes, such as blast holes 24 and 26, respectively, to feed fuel gas and feed gas, respectively, to the rubblized mass beneath roof 16. More than one downhole burner, fuel gas line and feed gas line can be used, if desired.

A collection basin is dug and a sump installed in the bottom of access tunnel 20 near the retort. Oil, water and gas lines are laid in the tunnel so as to extend from the collection basin to above ground. The lines are connected to pumps, blowers and various collection equipment. An upright concrete wall is installed in the tunnel 20 to prevent leakage of off gas into the mine.

In order to commence retorting of the rubblized mass 18 of oil shale, a liquid or gaseous fuel, preferably a combustible ignition gas or fuel gas, such as recycled off gases or natural gas, is fed into the retort through the fuel line, and an oxygen-containing, flame front-supporting, feed gas, such as air, is fed into the retort through the feed gas line. The downhole burners are then ignited to establish a flame front horizontally across the bed. The oxygen-containing feed gas sustains and drives the flame front downwardly through the bed 18 of oil shale. The feed gas can be air, or air enriched with oxygen, or air diluted with steam or recycle retort off gases. If economically feasible or otherwise desirable, the rubblized mass of oil shale can be preheated to a temperature slightly below its retorting temperature with an inert preheating gas, such as steam, nitrogen or off gases emitted from the retort, before introduction of feed gas and ignition of flame front. After ignition, the inflow of fuel gas is shut off. Once the flame front is established, residual carbon contained in the oil shale usually provides an adequate source of fuel to maintain the flame front for rich oil shale as long as the oxygen-containing feed gas is fed to the flame front. Recycled off gases or shale oil may be needed to supplement the fuel supply for leaner shale.

The flame front emits combustion off gases and generates heat which move downwardly ahead of the flame front and heats the raw, unretorted oil shale to a retorting temperature from 900° F. to 1,200° F. to retort and pyrolyze the oil shale. The oil shale is progressively retorted downwardly through the retort leaving a layer or band of retorted shale containing carbon residue. The carbon residue on the retorted shale is combusted by the flame front, leaving spent, combusted shale. During retorting, hydrocarbons are liberated from the raw oil shale as a gas, vapor, mist or liquid droplets, and most likely a mixture thereof. The liberated hydrocarbons include light gases and normally liquid shale oil which flow downward, condense and liquify upon the cooler, unretorted raw shale below the retorting zone.

Off gases emitted during retorting include various amounts of hydrogen, carbon monoxide, carbon dioxide, ammonia, hydrogen sulfide, carbonyl sulfide, oxides of sulfur and nitrogen and all molecular weight hydrocarbons. The composition of the off gas is dependent on the composition of the feed gas.

The effluent product stream of liquid oil, retort water and off gases mixed with light gases and steam emitted during retorting, flow downward to the sloped bottom of the retort and then into the collection basin and sump in the bottom of the access tunnel. The liquid shale oil, water and gases are separated in the collection basin by gravity and pumped to the surface.

Among the many advantages of forming and retorting an in situ oil shale retort in accordance with the above process are:

1. Less channeling.
2. Decreased explosion gas turbulence.
3. Greater shale occupancy of the void.
4. Enhanced uniformity of flame front.
5. Less loss of product oil.
6. Decreased carbonate decomposition and thermal cracking of the effluent shale oil.
7. Improved product yield and recovery.

Although an embodiment of this invention has been shown and described, it is to be understood that various modifications and substitutions, as well as rearrangements and combinations of process steps, can be made by those skilled in the art without departing from the novel spirit and scope of this invention.

What is claimed is:

1. A process for forming an in situ oil shale retort, comprising the steps of:

mining a lateral access tunnel into the bottom of an underground formation of oil shale;

removing from 10% to 40% of said oil shale from said formation to provide an underground cavity defining a void;

conveying said removed oil shale above ground;

drilling a plurality of blast holes extending generally vertically through the top portion of said underground formation;

forming at least two generally upright vent holes extending through the top portion of said underground formation so that the total horizontal cross-sectional area of said vent holes and said blast holes is generally equal to the vertical cross-sectional area of said access tunnel;

setting explosive charges in said blast holes;

detonating said charges to explosively expand said oil shale into a permeable rubblized mass substantially filling said void;

said charges emitting explosive gases upon detonation; and venting said explosion gases through said vent holes, blast holes and said access tunnel to substantially minimize channeling in said rubblized mass.

2. A process in accordance with claim 1 including drilling a checkered array of blast holes and a symmetrical pattern of vent holes.

3. A process in accordance with claim 1 including drilling circular arrays of blast holes and vent holes.

4. A process in aocordance with claim 1 including boring a set of vent holes generally along the periphery and corners of said top portion.

5. A process in accordance with claim 1 wherein said cavity is formed near the middle of said formation.

6. A process in accordance with claim 1 wherein said cavity is formed near the bottom of said formation.

7. A process in accordance with claim 1 wherein said cavity is formed near the top of said formation.

8. A process in accordance with claim 1 including communicating and extending said vent holes, blast holes and tunnel generally upwardly to the surface and venting said explosion gases to the atmosphere above ground.

9. A process in accordance with claim 8 wherein:

said rubblized mass defines a generally upright retort with a roof and elongated walls;

a downhole burner is lowered into one of said holes to a location in proximity to said roof for igniting a flame front generally across said retort;

a feed gas line is inserted into another one of said holes for supporting said flame front with an oxygen-containing feed gas; and said venting substantially minimizes channeling along said walls to enhance uniformity of said flame front.

* * * * *

UNITED STATES PATENT OFFICE
CERTIFICATE OF CORRECTION

Patent No. 4,447,090 Dated May 8, 1984

Inventor(s) KNEPPER, JAY C.

It is certified that error appears in the above-identified patent and that said Letters Patent are hereby corrected as shown below:

| Patent reads: | and should read: |
|---|---|
| Front Page - Item 73 | Front Page - Item 73 |
| Standard Oil Company, a corporation of Indiana; Gulf Oil Corporation a corporation of Pennsylvania, both of Chicago, Ill. | Standard Oil Company, a corporation of Indiana, Chicago, Illinois and Gulf Oil Corporation, a corporation of Pennsylvania, Pittsburgh, Pennsylvania |

| Column | Line | |
|---|---|---|
| 6 | 30 | "Aocordance" should read --accordance-- |

Signed and Sealed this

Twenty-eighth Day of April, 1987

*Attest:*

DONALD J. QUIGG

*Attesting Officer*

*Commissioner of Patents and Trademarks*